US011156365B2

(12) United States Patent
Rickert et al.

(10) Patent No.: US 11,156,365 B2
(45) Date of Patent: Oct. 26, 2021

(54) HEATING DEVICE FOR A HOB, AND HOB

(71) Applicant: E.G.O. Elektro-Geraetebau GmbH, Oberderdingen (DE)

(72) Inventors: Jochen Rickert, Oberderdingen (DE); Volker Block, Bretten (DE); Marcus Frank, Sulzfeld (DE); Gabriel Rupp, Bretten (DE); Tilo Fucik, Walzbachtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 207 days.

(21) Appl. No.: 16/508,656

(22) Filed: Jul. 11, 2019

(65) Prior Publication Data

US 2020/0025388 A1 Jan. 23, 2020

(30) Foreign Application Priority Data

Jul. 19, 2018 (DE) ..... 10 2018 212 094.3

(51) Int. Cl.
*H05B 3/68* (2006.01)
*F24C 7/08* (2006.01)
(Continued)

(52) U.S. Cl.
CPC ..... *F24C 7/083* (2013.01); *F24C 7/046* (2013.01); *F24C 7/067* (2013.01)

(58) Field of Classification Search
CPC ..... F24C 7/046; F24C 7/067; F24C 7/083; H05B 2206/022; H05B 2213/03;
(Continued)

(56) References Cited

U.S. PATENT DOCUMENTS 3,130,664 A * 4/1964 Jarmuth ..... F24C 15/102 99/425
4,073,970 A 2/1978 Allen
(Continued)

FOREIGN PATENT DOCUMENTS

DE 3407965 A1 9/1985
DE 4007680 A1 9/1991
(Continued)

OTHER PUBLICATIONS

European Search Report for European Patent Application No. 19185136.9, dated Dec. 18, 2019, (5 pages), European Patent Office, München, Germany.
(Continued)

*Primary Examiner* — Sang Y Paik
(74) *Attorney, Agent, or Firm* — Alston & Bird LLP

(57) ABSTRACT

A heating device for a hob has a flat rectangular carrier with an outer edge, two heating elements which each have a heating conductor and which together form a heating area and which are fastened on the carrier, wherein each heating element defines a partial heating area, and the partial heating areas are situated inside the rectangular shape of the carrier. The heating elements and their partial heating areas can be operated independently of one another. The partial heating areas of the heating elements do not intersect. A first partial heating area is rectangular and extends, by way of at least one of its outer sides, to the outer edge of the carrier and runs parallel in relation to the outer edge. A second partial heating area covers the portion of the rest of the carrier which is left free by the first partial heating area. Various configurations of heated areas can be achieved owing to the independent operation.

16 Claims, 5 Drawing Sheets

(51) Int. Cl.
*F24C 7/04* (2021.01)
*F24C 7/06* (2006.01)

(58) Field of Classification Search
CPC ... H05B 3/70; H05B 3/72; H05B 3/74; H05B 3/748; H05B 3/68; H05B 3/681–688
USPC ..... 219/443.1–468.2, 538–547
See application file for complete search history.

(56) References Cited

U.S. PATENT DOCUMENTS 4,584,850 A 4/1986 Haltenhof
4,754,123 A * 6/1988 Kicherer ..... H05B 1/0216 219/448.19
4,778,978 A 10/1988 Schreder et al.
4,901,049 A 2/1990 Kicherer et al.
5,413,032 A * 5/1995 Bruno ..... A47J 37/0676 219/436
2002/0033390 A1* 3/2002 Von Mosshaim ..... F24C 15/30 219/452.11
2005/0051533 A1 3/2005 Yang et al.
2016/0157301 A1* 6/2016 Garde Aranda ..... H05B 3/68 219/622
2017/0231033 A1* 8/2017 Tiner ..... H05B 3/22

FOREIGN PATENT DOCUMENTS

DE 102004058473 A1 6/2006
GB 2392499 A 3/2004

OTHER PUBLICATIONS

German Patent Office, Office Action for German Patent Application No. 102018212094.3, dated Apr. 12, 2019, 5 pages, Germany.

* cited by examiner

HEATING DEVICE FOR A HOB, AND HOB

CROSS-REFERENCE TO RELATED APPLICATIONS

This application claims priority to German Application No. 10 2018 212 094.3, filed Jul. 19, 2018, the contents of which are hereby incorporated herein in its entirety by reference.

BACKGROUND

The invention relates to a heating device for a hob, and also to a hob comprising a plurality of heating devices of this kind.

A technology which is known and well proven in hobs for the heating devices are radiant heating devices. Heating devices of this kind are known in detail, for example, from U.S. Pat. No. 4,778,978. In the said document, a hob is provided with a plurality of identical heating devices each with a rectangular carrier on which heating elements are arranged, advantageously two heating elements with one heating conductor in each case. Here, the heating conductors run in an interengaging square-spiral manner inside a joint heating area which is delimited by an encircling outwardly protruding outer edge of the carrier. In the hob, a plurality of these heating devices, for example four heating devices, can be arranged relatively close to one another in order to achieve continuous heating as far as possible or in order to utilize the surface area of the hob as well as possible.

BRIEF SUMMARY

The invention is based on the problem of providing a heating device of the kind mentioned in the introductory part and also a hob which is provided with heating devices of this kind, with which heating device and hob problems of the prior art can be solved and it is possible, in particular, to realize advantageous ways of heating on the hob with cooking vessels of different sizes.

This problem is solved by a heating device having the features of claim 1 and also by a hob having the features of claim 14. Advantageous and preferred refinements of the invention are the subject matter of the further claims and will be explained in more detail below. In so doing, some of the features will be explained only for the heating device or only for the hob. However, irrespective of this, they are intended to be able to apply both to the heating device and also to the hob on their own and independently of one another. The wording of the claims is incorporated in the description by express reference.

Provision is made for the heating device to have a flat carrier with an outer edge. This flat carrier can advantageously be planar, but it does not have to be. The outer edge can furthermore be raised, but this is not compulsory either. In each case, the outer edge delimits the carrier towards the outside. The carrier has a substantially rectangular shape, in particular with slightly rounded or bevelled corners. Respectively opposite sides are advantageously parallel in relation to one another. Furthermore, the heating device has at least two heating elements, advantageously arranged fastened on the carrier. The heating elements each have at least one heating conductor and together form a heating area which advantageously corresponds approximately to the surface area of the carrier. A heating element could also have two heating conductors. Heating elements or heating conductors advantageously generate radiant heat in the upwards direction during operation.

A heating conductor is advantageously defined in that it has two ends and can be electrically connected or contacted at each of these two ends for operation purposes. Furthermore, provision is made for the heating elements and/or the partial heating areas to be able to be operable or operated independently of one another. To this end, they can each have dedicated electrical connections or even can be electrically contacted separately from one another. Some connections of a plurality of heating elements or partial heating areas can also be jointly provided, as is known per se for heating devices of this kind and in particular radiant heating devices.

The heating conductors are fastened on the carrier, possibly partially embedded in a top side of the carrier. Each heating element defines a partial heating area, advantageously precisely one single partial heating area. In this case, the heating device has at least two partial heating areas, advantageously precisely two partial heating areas. These partial heating areas are situated inside the rectangular shape of the carrier, specifically inside the outer edge.

According to the invention, provision is made for the partial heating areas of a heating device to not intersect, that is to say for the said partial heating areas to run separately from one another. In this case, provision can be made for a partial area to be everywhere that a heating conductor of the associated heating element runs, that is to say the surface area of the said partial area is defined by the said heating conductor. Therefore, provision is advantageously also made for no heating conductors to intersect or cross over. Furthermore, a first partial heating area is rectangular. The said first partial area extends, by way of at least one of its outer sides, to the outer edge of the carrier or to an inner side of this outer edge if it is raised, as has been described above. In this case, this at least one outer side of the partial heating area also runs parallel in relation to this outer edge to which it directly extends or close to which it extends.

Furthermore, according to the invention, the heating device has a second partial heating area correspondingly on a second heating element. This second partial heating area covers the rest of the carrier which is left free by the first partial heating area. In this case, provision can be made for the second partial heating area to be formed from more than one single heating element or from more than one single heating conductor, so that it can also be considered to be the sum of a plurality of further partial heating areas or to be formed by a plurality of further partial heating areas. In all cases, it is important within the scope of the invention for even the first partial heating area to be rectangular. The region of the carrier which is still left free by the first partial heating area is covered and therefore also heated by at least one heating element or at least one heating conductor.

Therefore, it is possible for the invention to provide a heating device comprising a carrier which has at least one rectangular partial heating area which can be operated separately and is situated at the edge of the carrier. Therefore, the said partial heating area can be very easily jointly operated with further partial heating areas of a further heating device, which is arranged closely next to it, as a so-called bridge or bridged heating device for heating corresponding cooking vessels, for example elongated-oval roasting pans.

The heating elements for the heating conductors are advantageously resistance heating elements and to this end are designed to incandesce or even light up to some extent during operation. Therefore, the said heating elements or heating conductors heat cooking vessels placed over them by means of their radiant heating power. This is also known from U.S. Pat. No. 4,778,978 which was mentioned in the introductory part.

In one refinement of the invention, provision can be made for the first partial heating area to extend, by way of two of its outer sides which advantageously butt against one another or form a corner with one another, to the outer edge or to an inner side of the outer edge of the carrier. In this case, they also run parallel thereto. Therefore, the first partial heating area can preferably be situated, as it were, in a corner or in a corner region of the carrier. Therefore, it can be jointly operated not only with a single further partial heating area of an adjacent heating device as an abovementioned bridge or bridged heating device, but rather also or as an alternative with a yet further partial heating area of a yet further heating device. In particular, provision may be made in the case of a hob according to the invention for not only at least two heating devices according to the invention to be arranged next to one another in the said hob in such a way that they are at a short distance from one another. This distance can be, in particular, a distance of less than 2 cm, so that the respectively first partial heating areas of the two heating devices can be situated, by way of the outer side, adjacent and parallel in relation to one another. It is even possible for four heating devices of this kind to be arranged in a square and also for four partial heating areas to butt against one another at the central point where four corners butt against one another. The corners of the said partial heating areas are then each only at a short distance from one another, advantageously of less than 2 cm to 4 cm. Here, these four partial heating areas or in each case two adjacent partial heating areas can then be jointly operated, depending on a size of a cooking vessel to be heated.

In a hob of this kind, it is also possible, in particular, for the respective first partial heating areas, which are adjacent and situated parallel in relation to one another, of the heating devices to be situated congruently or parallel next to one another over the same length in each case in particular. In this way, they create a joint heating area which, in turn, is rectangular.

In an advantageous refinement of the invention, the first partial heating area has a square shape. In general, an outer side of the first partial heating area can have a length of between 100 mm and 200 mm, preferably of between 110 mm and 150 mm. This is a routine measure for customary cooking vessel sizes, in particular even if an elongate oval roasting pan as mentioned in the introductory part is intended to be heated by two of the said partial heating areas. Frequently used cooking vessels with a diameter of 150 mm have an inner square with an edge length of almost 110 mm. The abovementioned roasting pans often have a length of between 250 mm and 400 mm along their larger longitudinal extent. An abovementioned square shape having the said size is also highly suitable here.

The second partial heating area preferably has an L shape, so that the first partial heating area is situated in the internal angle formed as a result. The first partial heating area and the second partial heating area together particularly advantageously form a rectangular or square surface area, specifically covering the flat carrier as far as its outer edge or as far as its inner side. As has been explained in the introductory part, the second partial heating area can also be formed, in turn, by a plurality of separately operable heating elements or heating conductors. In this case, the second partial heating area can preferably have limbs of approximately the same width but which can be of different lengths. The length difference can amount to the factor 1.2 to 2.5, advantageously 1.5 to 2.

In a refinement of this kind of a heating device, a small rectangular surface area can be separately heated in accordance with the first partial heating area, generally for a relatively small cooking vessel. Operation of the second partial heating area alone will generally not make any sense since correspondingly shaped cooking vessels are not customary. A possible next-biggest surface area to be treated for a cooking vessel is advantageously the joint operation of the first partial heating area and of the second partial heating area, and therefore the entire heating device. This may be suitable for medium-sized cooking vessels.

As explained above, two adjacent first partial heating areas can be heated for elongate roasting pans. Two heating devices which are situated next to one another, that is to say their first and second partial heating areas in each case, can be fully operated for very large cooking vessels or very large roasting pans. Therefore, a hob according to the invention provides a large variety of options for combining heated surface areas, as a result of which it is possible for cooking vessels of different sizes and/or different shapes to be heated as well as possible in an efficient and rapid manner.

For the carrier itself, provision is advantageously made for the said carrier to have an especially square shape. In this case, the first partial heating area is also practically square or has a difference in its side lengths of at most 10%. In a further refinement of the invention, provision can be made for a hob according to the invention for at least one heating device to be of square design according to the invention and at least one heating device to be of rectangular design according to the invention. The said heating devices can be arranged partially close to one another or next to one another in order to allow, in combination, heating of surface areas which are as different or variable as possible.

In one refinement of the invention, an elongate temperature sensor or temperature limiter can be provided, which temperature sensor or temperature limiter runs above the heating elements or the heating conductors. A temperature sensor or temperature limiter of this kind runs at least over the first partial heating area, possibly also over the second partial heating area. Since, in the case of a heating device of this kind as has been explained in the introductory part, the first partial heating area is preferably always operated if the heating device is operated at all, the said first partial heating area is safeguarded in respect of a possibly dangerous excessive temperature. If the temperature sensor or temperature limiter in elongate form also runs over the second partial heating area, the said second partial heating area can also be safeguarded as it were. Here, the temperature sensor or temperature limiter can be compensated, as is known from U.S. Pat. No. 4,901,049 and primarily from DE 102004058473 A1 by using different materials. In principle, elongate temperature sensors or temperature limiters of this kind are known from the prior art, and they are also referred to as safety temperature limiters or rod-type thermostats. In this respect, reference is also made to U.S. Pat. No. 4,778,978 which was mentioned in the introductory part and also discloses this. An elongate temperature sensor or temperature limiter of this kind is advantageously a thermomechanical component and operates with thermal expansion, as a result of which a switch is opened or closed in accordance with a specific temperature given a specific expansion travel. A power supply for the heating device or one of the heating elements or heating conductors is advantageously automatically disconnected when an excessively high temperature is detected.

Provision can advantageously be made for the elongate temperature sensor or temperature limiter to run from an outer edge of the carrier over at least half the extent of the carrier in the direction of the longitudinal direction of the temperature sensor or temperature limiter itself over at least the first partial heating area. In other words, the elongate temperature sensor or temperature limiter covers at least half the surface area of the first partial heating area. Provision can particularly advantageously be made for the elongate temperature sensor or temperature limiter to entirely cover the first partial heating area. In a yet further refinement of the invention, provision can be made for the temperature sensor or temperature limiter to run from an outer edge of the carrier as far as the opposite outer edge of the carrier, that is to say to span the entire carrier or its surface area as it were. In this case, it should also run above the first partial heating area in all cases, so that the said first partial heating area is safeguarded against excessive temperature.

As an alternative to an abovementioned elongate temperature sensor or temperature limiter, a small or point-type temperature sensor which is also arranged over or above at least the first partial heating area can be provided on the heating device. A small or point-type temperature sensor of this kind can be printed onto the bottom side of a hob plate of the hob and directly detect the temperature here since rod-type thermostats or safety temperature limiters of this kind are usually intended to monitor and limit a maximum temperature of the hob plate. A small temperature sensor of this kind can be formed by a PTC resistor, an NTC resistor or a thermocouple, that is to say allow direct temperature measurement. Small or point-type temperature sensors of this kind are electrically or electronically evaluated in order to determine a temperature signal on the basis of which a possibly excessive temperature can be established.

In one possible design of the invention, combinations of the abovementioned elongate temperature sensors and small or point-type temperature sensors, in particular with a PTC resistor, NTC resistor or thermocouple, can also be formed. To this end, either any desired positioning can be provided, or as an alternative the small or point-type temperature sensors can be arranged, for example clipped, on an elongate temperature sensor.

In a refinement of the invention, it is possible for a further small or point-type temperature sensor of this kind to be arranged in the region of the second partial heating area. The said temperature sensor can also be arranged above the said second partial heating area or in the same way as the other temperature sensor in the region of the first partial heating area.

In a further advantageous refinement of the invention, the electrical connections to a heating device are provided only on one side of the carrier, specifically for all partial heating areas. An abovementioned temperature sensor or temperature limiter can also be electrically contacted on this side. In this case, provision can advantageously be made for the electrical connections of the first partial heating area to be physically somewhat separate or to be at a distance from the electrical connections of a second partial heating area. Respectively different so-called connection blocks or connection plug-in apparatuses can also be provided. This facilitates electrical connection when assembling the heating device or the hob. Furthermore, the other sides of the heating device then remain free of electrical connections of this kind which necessarily project beyond the outer side or the outer edge. This provides the option of being able to arrange the heating devices very close to one another on at least one side, advantageously or two or even on three sides, and possibly even being able to be in contact in order to achieve small intermediate gaps.

Electrical connections can advantageously be configured in a known manner with plug-in connections, advantageously plug-in connection plugs which protrude to the outside from the heating device. Connection sections of the plug-in connection plugs can extend towards the inside, so that ends of the heating conductors can be welded to them.

In a hob, under certain circumstances, heating devices can even be arranged close to one another in such a way that their outer edges are in contact. Specifically when partial heating areas of two heating devices which are situated next to one another are jointly operated in an abovementioned bridge mode, it is advantageous when a non-heated region between them is as narrow as possible. Even a raised outer edge of the carrier may possibly be thinner in this region than in other regions in which no further heating device is provided directly next to it or even is in contact with it. In this case, specifically the thicknesses of two thin outer edges of this kind which are in contact are added up, as a result of which an overall sufficiently thick outer edge can be created in turn. Furthermore, the lateral transfer of heat is not very disruptive here since the adjacent heating device which is heated in this way is itself highly temperature-resistant.

In a yet further refinement of the invention, provision can be made for there to be two types of heating devices which are formed with mirror-image symmetry in relation to one another. The said heating devices can then be arranged next to one another in a hob according to the invention. A centre line which runs centrally between the two heating devices forms an axis of mirror-image symmetry for the two heating devices. In this case, in each heating device, the first partial heating area is arranged towards the adjacent heating device or its first partial heating area, so that these are situated next to one another and can have a bridge function.

In a further refinement of a hob, the rectangular heating devices according to the invention can also be combined with further heating devices which are of round or oval design. For example, a left-hand-side or a front region of the hob can be covered by rectangular heating devices on the one hand or round or oval heating devices on the other hand, and the respectively other region can be covered by heating devices of the other shape.

In a yet further refinement of the invention, provision can be made for precisely two rectangular heating devices of identical size to be arranged next to one another in a rear region of the hob. The said two heating devices are advantageously both rectangular, preferably not square. A distance between them can particularly advantageously be at most 10 cm, advantageously between 2 cm and 5 cm. Precisely two heating devices of identical size, preferably square, are likewise arranged next to one another in a front region of the hob. The two heating devices, by way of in each case the outer sides of their first partial heating areas, are situated adjacent and parallel in relation to one another on at least the left-hand or the right-hand side of the hob, so that they can be readily bridged. In this case, the outer sides of their first partial heating areas are each congruent or situated parallel next to one another over the same length in each case. A bridge function from front to rear can be provided in this case.

In a yet further refinement of the abovementioned design of a hob, heating devices of the same shape can be provided in each case, in particular exclusively heating devices with a square shape. Two heating devices which are situated one behind the other run with their mutually facing outer edges parallel in relation to one another, advantageously at a very short distance as explained above. However, they are not completely congruent but rather offset to the side in relation to one another to a certain extent, for example by 2 cm to 5 cm. First partial heating areas, advantageously of a square shape, specifically in such a way that they are next to one another and congruent with one another, are in each case provided in the corner regions on the covering section. Therefore, the said first partial heating areas can be readily bridged with one another during joint operation. Particularly large roasting pans can then be heated by means of the two fully operated heating devices in the bridge mode.

In principle, heating areas or partial heating areas of different heating devices which have fundamentally different shapes can be bridged in a hob according to the invention. However, only partial heating areas of rectangular design are advantageously jointly operated as a bridge function, even if round or oval heating devices are also provided in the hob.

These and further features may be gathered from the claims and also from the description and the drawings, with the individual features being capable of being implemented in each case by themselves or severally in the form of sub-combinations in an embodiment of the invention and in other fields and being capable of constituting advantageous and independently patentable versions for which protection is claimed here. The subdivision of the application into individual sections and intermediate headings does not restrict the general validity of the statements made under these.

BRIEF DESCRIPTION OF THE DRAWINGS

Exemplary embodiments of the invention are schematically illustrated in the drawings and will be explained in more detail below. In the drawings.

DETAILED DESCRIPTION

Figure 1:
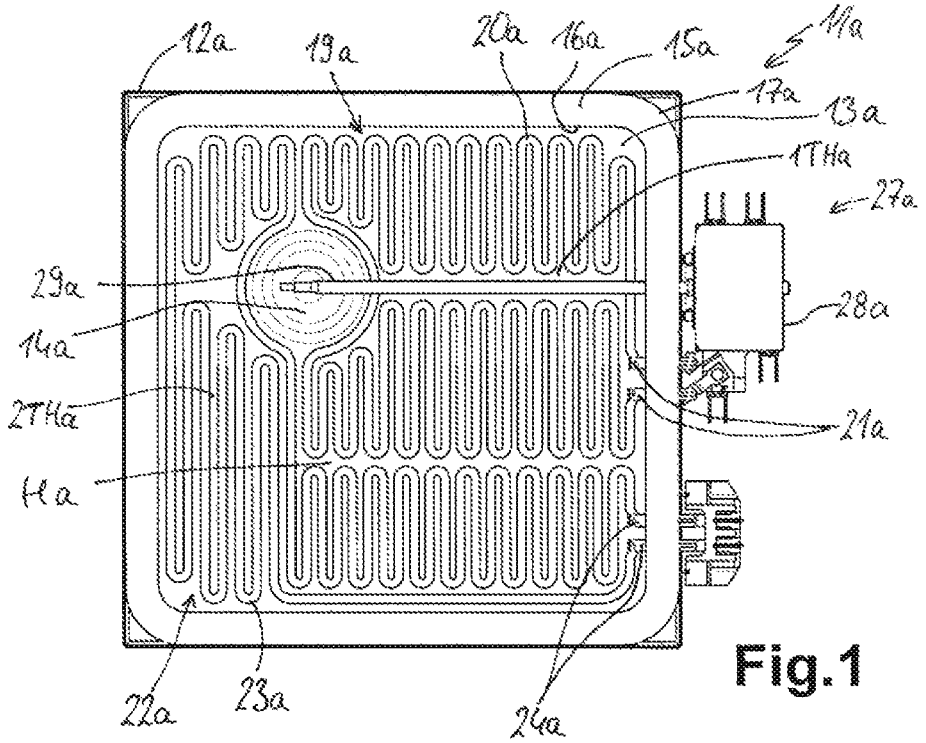
FIG. 1 shows a plan view of a first refinement of a heating device according to the invention having two heating elements which each define a partial heating area, wherein the heating device has a square outer shape.

FIG. 1 illustrates a plan view of a heating device 11*a*, which is designed as a radiant heating device, according to a first refinement of the invention. The heating device 11*a* is, as is customary for radiant heating devices, arranged in a sheet-metal tray 12*a* which has a square outer shape here. The heating device 11*a* further has a carrier 13*a* which is arranged in the sheet-metal tray 12*a* and which is composed of a suitable thermally insulating and electrically insulating material. A wide outer edge which protrudes upwards and can be a separate part or can be integrally formed during production runs around the carrier 13*a*. The said wide outer edge is composed of a similar material to the carrier 13*a*. The outer edge 15*a* has rounded corners for reasons of production. Apart from these rounded corners, the outer edge 15*a* is rectangular or here even square, just like the carrier 13*a*. Furthermore, the outer edge 15*a* has an inner side 16*a* which, as it were, delimits the top side of the carrier 13*a*. Similarly, the outer edge 15*a* has an outer side 17*a* by way of which it bears largely against a raised edge of the sheet-metal tray 12*a*.

Figure 2:
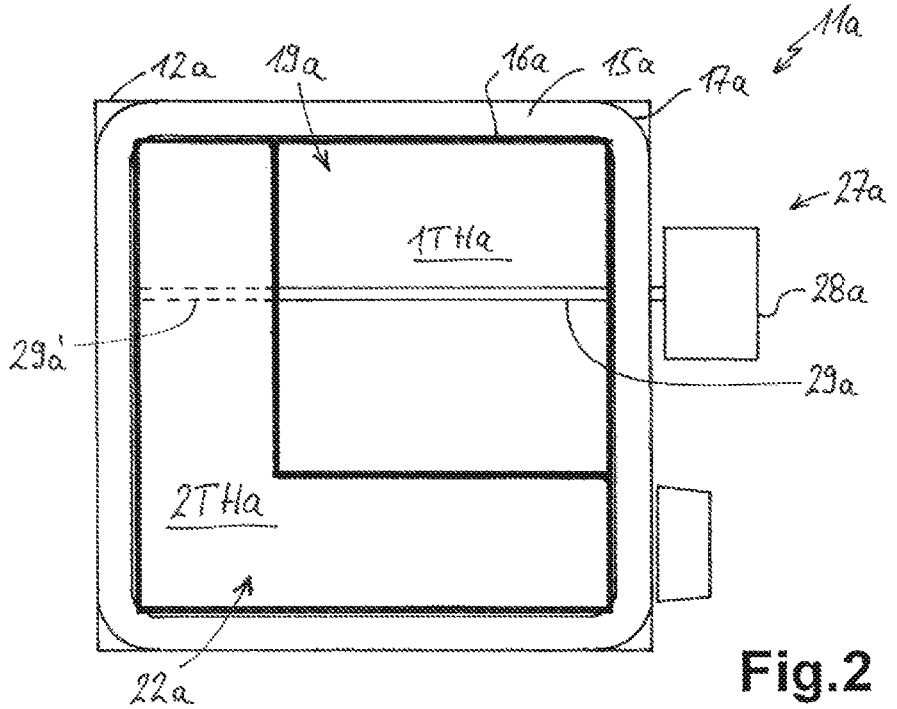
FIG. 2 shows a functionally schematic illustration of the heating device from FIG. 1 with a square first partial heating area and an L-shaped second partial heating area.

A first heating element 19*a* which consists of a first heating conductor 20*a*, specifically of a single heating conductor 20*a*, is provided on the carrier 13*a*. This elongate heating conductor 20*a* is laid in a meandering manner in two parallel tracks and has two first connections 21*a* which protrude through the outer edge 15*a* to the outside for electrical connection purposes. FIG. 2 shows that the first heating element 19*a* forms, with the first heating conductor 20*a*, a first partial heating area 1THa which is not only rectangular but which can also be considered to be square. The first heating conductor 20*a* runs around a raised portion 14*a* of the carrier 13*a*, so that no heating conductor and therefore no heating is provided in the region of the raised portion 14*a*. Nevertheless, the said first partial heating area 1THa can be considered, as the outer boundaries, to be accordingly square. This also applies to the corners according to FIG. 2, in particular the top-right corner and the bottom right corner.

The heating device 11*a* further has a second heating element 22*a* which covers, as it were, the rest of the surface area of the carrier 13*a*. To this end, a second heating conductor 23*a* is laid in a meandering manner with a different width on the carrier 13*a*; it forms the second partial heating area 2THa. The second heating conductor 23*a* of the second heating element 22*a* is guided to second connections 24*a* which, in turn, protrude through the outer edge 15*a* to the outside. As shown in FIG. 2, the second partial heating area is of L-shaped or angular design with the same simplifications as above for the first partial heating area 1THa. Since the carrier 13*a* is square, and the first partial heating area 1THa is likewise square and is positioned in the top-right corner of the carrier 13*a*, the second heating element 22*a* or the corresponding second partial heating area 2THa has an L shape with two limbs of equal length and equal width.

The two partial heating areas 1THa and 2THa jointly form a heating area Ha of the heating device 11*a*, that is to say a square surface area can be heated overall. The laying pattern of FIG. 1 for the two heating conductors 20*a* and 23*a* shows that they do not cross over, which is relatively self-evident. However, furthermore, the respective partial heating areas which are formed by each of the heating conductors 20*a* and 23*a* do not cross over and overlap either.

A rod-type thermostat 27*a*, which is designed as is known in the prior art, is fitted to the heating device 11*a* on the right-hand side. The rod-type thermostat 27*a* has a rod-type thermostat housing 28*a* from which an elongate thermomechanical temperature sensor 29*a* protrudes into the heating device 11*a* or runs above the heating area Ha. The temperature sensor 29*a* extends as far as the raised portion 14*a* of the carrier 13*a* and is held by the said raised portion against being pressed downwards. Therefore, it is clear that in FIG. 1 the rod-type thermostat 27*a* thermally monitors only the first partial heating area 1THa and switches off at an excessive temperature, as is known from the prior art and does not need to the explained in any detail. FIG. 2 illustrates how the temperature sensor 29*a* could be extended by way of an extension 29*a*', illustrated using dashed lines, which then also covers a portion of the second partial heating area 2THa. Therefore, the second heating element 22*a* can also be thermally monitored, but this does not have to be the case. Here, the rod-type thermostat, as temperature sensor, can be compensated, as is known from the above-mentioned documents U.S. Pat. No. 4,901,049 and DE 102004058473 A1.

The first connections of the first heating element 19*a* and, respectively, of the first heating conductor 20*a* are guided and electrically connected to the rod-type thermostat housing 29. The second connections 24*a* of the second heating conductor 23*a* are held in a so-called connection block, advantageously composed of ceramic material. Therefore, they can be easily contacted by a plug from the side. The first connection of the connection block is connected to the contact of the rod-type thermostat 27*a* by means of a stranded wire, not shown, so that both heating elements can be switched off, even if only the first heating element is monitored, when the rod-type controller 27*a* is switched.

Figure 3:
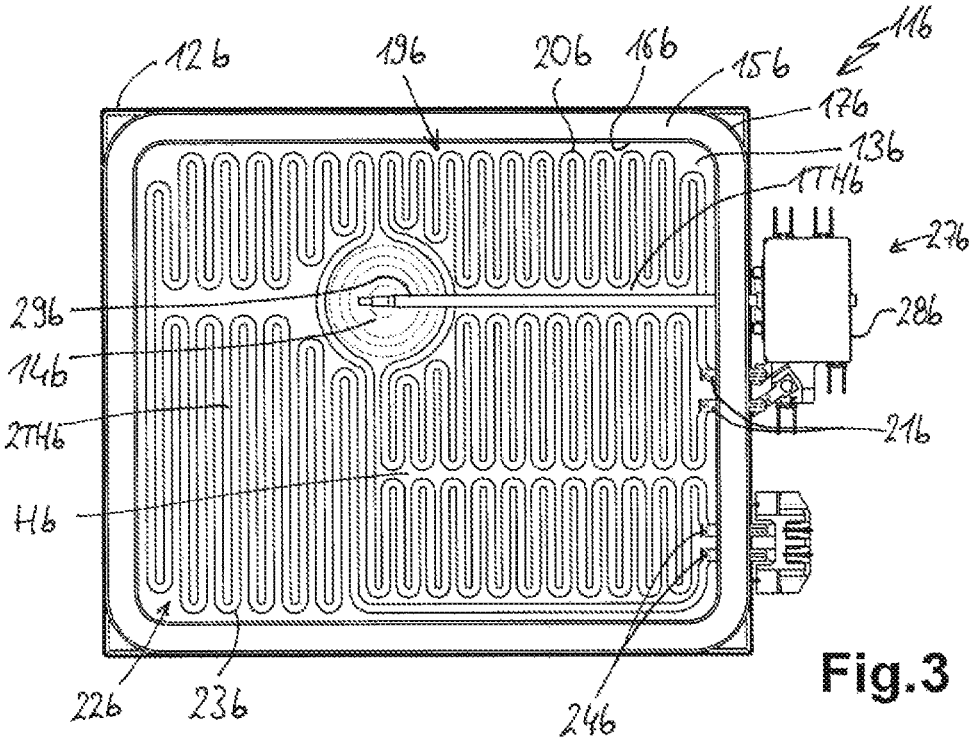
FIG. 3 shows a plan view of a further heating device according to the invention based on that according to FIG. 1 with a square outer shape.

FIG. 3 illustrates, as a modification, a further heating device 11*b* according to the invention, wherein the heating device 11*b* has a rectangular outer shape. A correspondingly suitable carrier 13*b* with a raised outer edge 15*b* which has an inner side 16*b* and an outer side 17*b* is inserted into a sheet-metal tray 12*b* with a rectangular outer shape. A raised portion 14*b* is also provided on the carrier 13*b*. Comparison of FIG. 1 and FIG. 3 shows that the heating device 11*b* of FIG. 3 is based, as it were, on the heating device 11*a* of FIG. 1, wherein something is attached on the left-hand side as it were.

The heating device 11*b* has a first heating element 19*b* which is formed by a first heating conductor 20*b* which has first connections 21*b*. This first heating element 19*b* corresponds precisely to the first heating element 19*a* from FIG. 1. A first partial heating area 1THb which is formed from the said first heating element, as shown at the bottom of FIG. 4, is square and sits, as it were, in the top-right corner of the overall heating area Hb of the heating device 11*b*.

Figure 4:
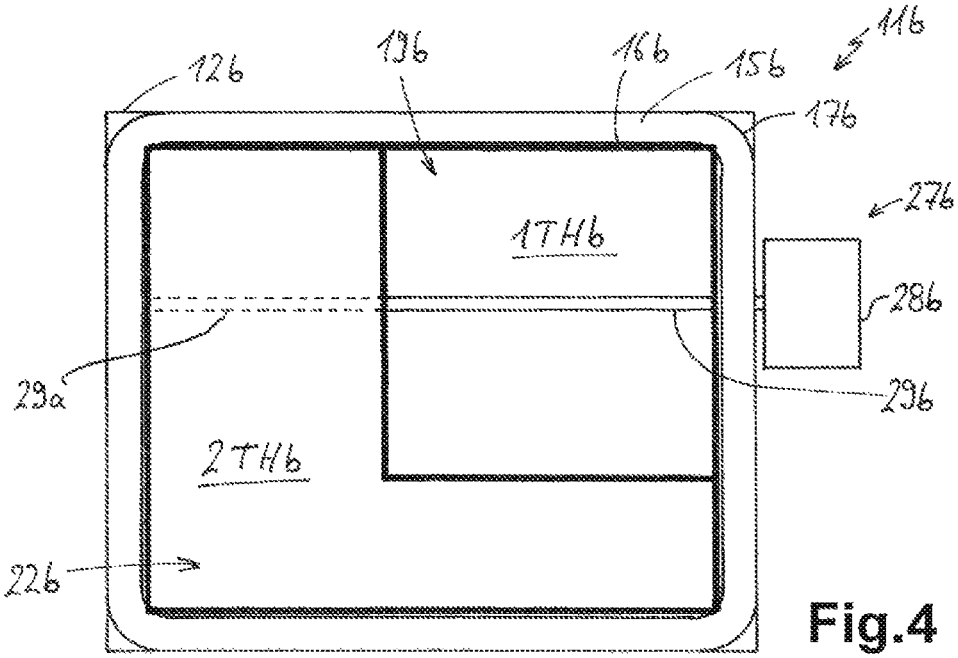
FIG. 4 shows a functionally schematic illustration of the heating device from FIG. 3 with a square first partial heating area and an L-shaped second partial heating area.

A second heating element 22*b* fills the rest of the heating area Hb apart from the raised portion 14*b* and forms, with a second heating conductor 23*b*, the second partial heating area 2THb, as is likewise shown in FIG. 4. Comparison of FIG. 2 and FIG. 4 with one another also clearly shows that something is attached on the left-hand side in the case of the second heating device 11*b*, in particular in the case of the second partial heating area 2THb, specifically to the extent that the second heating device 11*b* is longer in the direction from left to right than the first heating device 11*a*. The second heating conductor 23*b* can be electrically connected to the outside by way of second electrical connections 24*b* through the outer edge 15*b*.

A rod-type thermostat 27*b* which has a rod-type thermostat housing 28*b* with an elongate temperature sensor 29*b* is also provided in the case of the heating device 11*b*. FIG. 4 illustrates that the elongate temperature sensor 29*b*, on the left-hand side, in a manner illustrated using dashed lines, could extend, by way of an extension 29*b*', as far as beyond the entire heating area Hb and therefore also completely beyond this region of the second partial heating area 2THb which is somewhat wider than in FIG. 1.

FIG. 2 and FIG. 4 show that the respective first partial heating area 1TH could also be arranged at any desired other point on the carrier 13 or inside its heating area H. However, in this case, it would potentially be more difficult to lay the electrical supply lines, wherein this is feasible as will be found further below.

Figure 5:
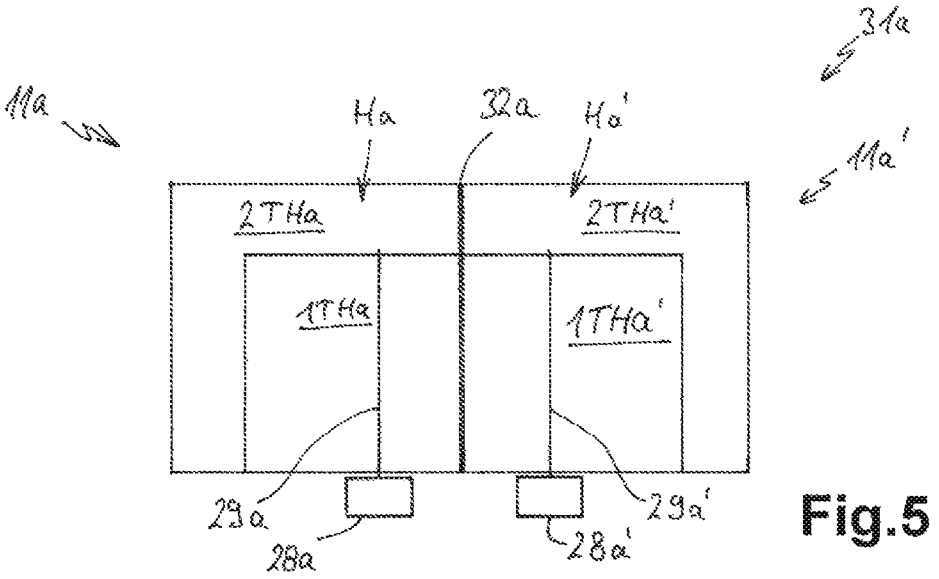
FIG. 5 shows an arrangement of two heating devices similar to FIGS. 1 and 2 directly next to one another which could be present, for example, in a hob, wherein the two first partial heating areas, by way of an outer side, are situated congruently next to one another.

FIG. 5 shows an arrangement 31*a* of two heating devices 11*a* according to and similar to the illustration of FIG. 2. However, it can only be seen that the left-hand-side heating device 11*a* is designed precisely as in FIG. 1 or FIG. 2; the right-hand-side heating device 11*a*' is only in principle of identical design, that is to say with partial heating areas of the same size. To be precise, the right-hand-side heating device is formed with mirror-image symmetry in relation to the left-hand-side heating device 11*a* with a mirror axis along a centre line 32*a* which runs between the two heating devices 11*a* and 11*a*'.

The two first partial heating areas 1THa and 1THa' adjoin one another by way of their sides which face one another. In this case, they are congruent in this respect because they are also of the same size. Therefore, it can be seen from this that a plurality of cooking vessels of different sizes can be heated or heating zones can be formed with the arrangement 31*a*. The smallest cooking vessel can be heated merely by one of the two first partial heating areas 1THa or 1THa'. A next-biggest cooking vessel can be heated by an entire heating device 11*a* or 11*a*', that is to say 1THa and 2THa for example. A smaller elongate or oval roasting pan can be heated by the two first partial heating areas 1THa and 1THa' in joint operation. An even larger elongate roasting pan or a very large cooking pot could be jointly heated by the two heating devices 11*a* and 11*a*'. It is clear from a first look at the shape of the second partial heating areas 2THa and, respectively, 2THa' that isolated operation thereof makes no sense.

Figure 6:
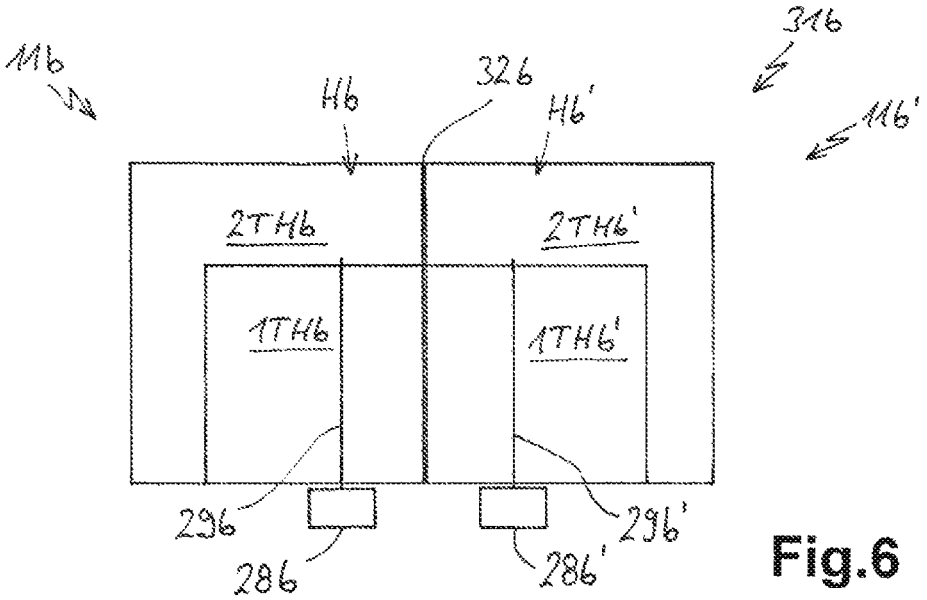
FIG. 6 shows a modification to the arrangement from FIG. 5 with use of heating devices similar to FIGS. 3 and 4.

FIG. 6 illustrates a further arrangement 31*b* which, in principle, is of similar construction to that from FIG. 5. A heating device 11*b* according to FIGS. 3 and 4 is provided on the left-hand side. A further heating device 11*b*' which is of the same size and same outer shape is provided on the right-hand side directly next to the said heating device and separated only by a centre line 32*b*. In a similar manner to that described above in relation to FIG. 5, the said further heating device is formed with mirror-image symmetry in relation to the left-hand-side heating device 11*b*, wherein it is possible for the two first partial heating areas 1THb and 1THb' to exhibit mirror-image symmetry and to virtually bare against one another by way of their outer sides which face one another.

In the illustrations of FIG. 5 et. seq., the thickness of the respective outer edge 15 is not taken into account when it is shown how partial heating areas or entire heating areas can bear against one another or can continue. However, the principle underlying the invention is nevertheless clearly understandable and comprehensible.

In the case of the arrangement 31*b* according to FIG. 6, heating as described above in relation to FIG. 5 can be performed using the respective first partial heating areas 1THb and 1THb'. Owing to the now somewhat larger second partial heating areas 2THb, improved adjustment to cooking vessels of different sizes may possibly be achieved.

Figure 7:
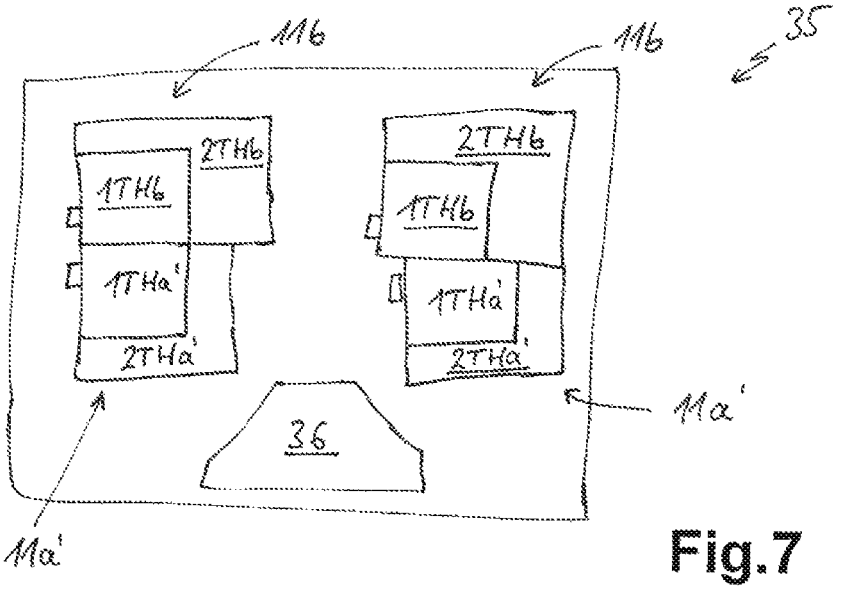
FIG. 7 shows a hob according to the invention comprising four heating devices and an operator control device, wherein precisely one heating device similar to FIG. 1 and a heating device according to FIG. 3 is in each case provided on the left-hand side and on the right-hand side.

FIG. 7 illustrates a plan view of a hob 35 according to the invention in a first refinement of the invention. The hob 35 has four heating devices 11, specifically two heating devices 11*a* and, respectively, 11*a*' with a square outer shape and two heating devices 11*b* and, respectively, 11*b*' with a rectangular outer shape. However, even more correspondingly designed heating devices, for example six or eight heating devices, could be provided in a hob. An operator control device 36, advantageously with touch switches, is arranged at the front in the centre.

In the hob 35, a heating device 11*a* and, respectively, 11*a*' with a square outer shape and a heating device 11*b* and, respectively, 11*b*' with a rectangular outer shape are respectively combined and installed close to one another. They can even be in contact. It can be seen how, in the heating device 11*a*' according to FIG. 5, the first partial heating area 1THa' is positioned in the top-left corner. The second partial heating area 2THa' is located therebelow on the right-hand side.

In the other upper heating device 11*b* according to FIGS. 3 and 4, the first partial heating area 1THb is arranged in the bottom-left corner, and the L-shaped second partial heating area 2THb extends above it and to the right. Therefore, a continuous bridge for heating an elongate cooking vessel can again be operated with the two first partial heating areas 1THa' and 1THb.

In the case of the right-hand-side arrangement of the heating devices 11*a*' and 11*b*, the offset is selected to be different to the left-hand side as an example of as large a number of different options for arrangement purposes. The two heating devices bear directly against one another, as do the respectively first partial heating areas 1THa' and 1THb. However, the outer sides which bear against one another are no longer congruent, but rather offset in relation to one another to a certain extent. Therefore, they can each still be arranged in the corners of the respective heating device, but the same heating devices 11 can be used on the left-hand side and the right-hand side in the hob 35. The offset between the two first partial heating areas can be somewhat surprising and have a thermally disruptive effect, but only to an insignificant extent, in practice.

Figure 8:
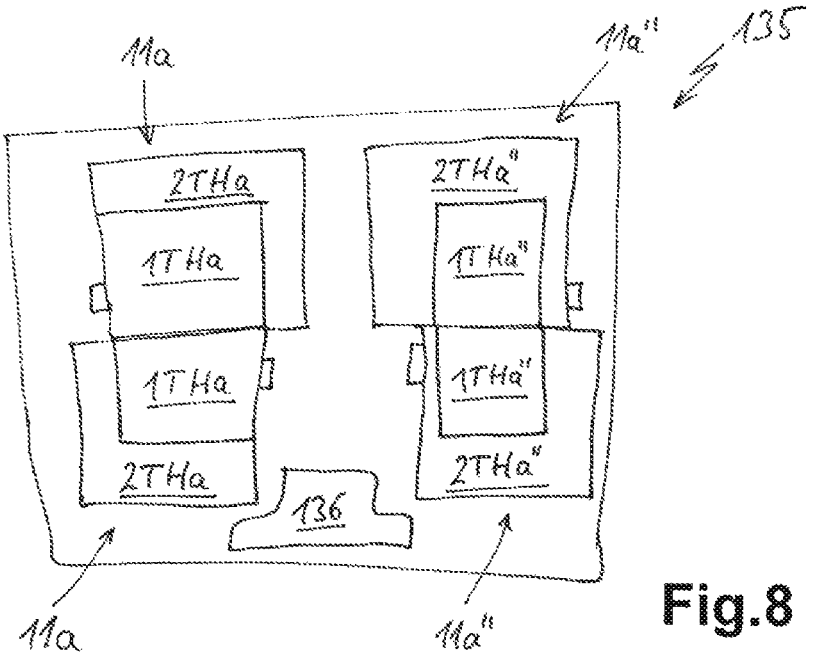
FIG. 8 shows a further hob according to the invention comprising four square heating devices and an operator control device, wherein four heating devices according to FIG. 1 are provided and are each offset in relation to one another.

A further hob 135 according to the invention in line with FIG. 8 has, on the left-hand side, two heating devices 11*a* according to FIGS. 1 and 2 which bear against one another but are not congruent, but rather offset to a certain extent. Their outer shape is square in each case. However, the respectively first partial heating areas 1THa bear congruently against one another.

On the right-hand side, two further square heating devices 11*a*" rest against one another but are arranged offset in relation to one another. There, a respective first partial heating area 1THa" is designed so as to butt against an outer side wall against the outer edge, but only on one outer side. The said first partial heating area is, as it were, not arranged in the corner. As a result, it is possible for the two heating devices 11*a*" to be arranged offset in relation to one another and for the first partial heating areas 1THa" to likewise not be arranged in the corner but nevertheless to be arranged congruently next to one another.

Comparison of FIGS. 7 and 8 with one another shows that the utilization of space in the hob behind the front central operator control device is somewhat better in the case of the hob 35 of FIG. 7.

Figure 9:
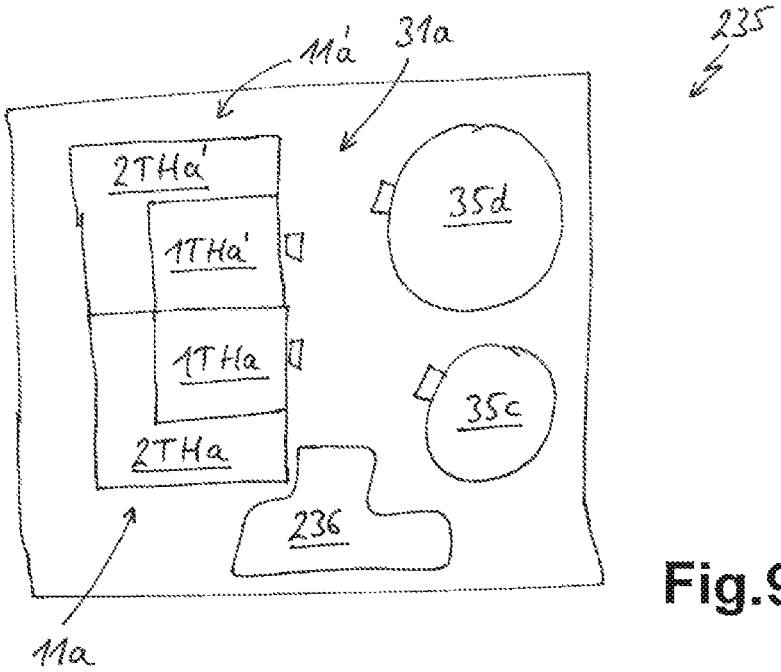
FIG. 9 shows a further hob according to the invention comprising four heating devices and an operator control device, wherein an arrangement of heating devices according to FIG. 4 is provided on the left-hand side and two round heating devices of different size are provided on the right-hand side.

FIG. 9 shows a further hob 235 according to the invention in which an arrangement 31*a* according to FIG. 5 of a heating device 11*a* and a heating device 11*a*' is provided behind a front central operator control device 236 on the left-hand side. Two round heating devices, specifically a small round heating device 35*c* at the front and a larger round heating device 35*d* at the rear, are located in the right-hand half of the hob 235. These heating devices are in no way subdivided into different partial heating areas. On account of their respective size, they are easily matched to the available space even taking into account the operator control device 236.

Figure 10:
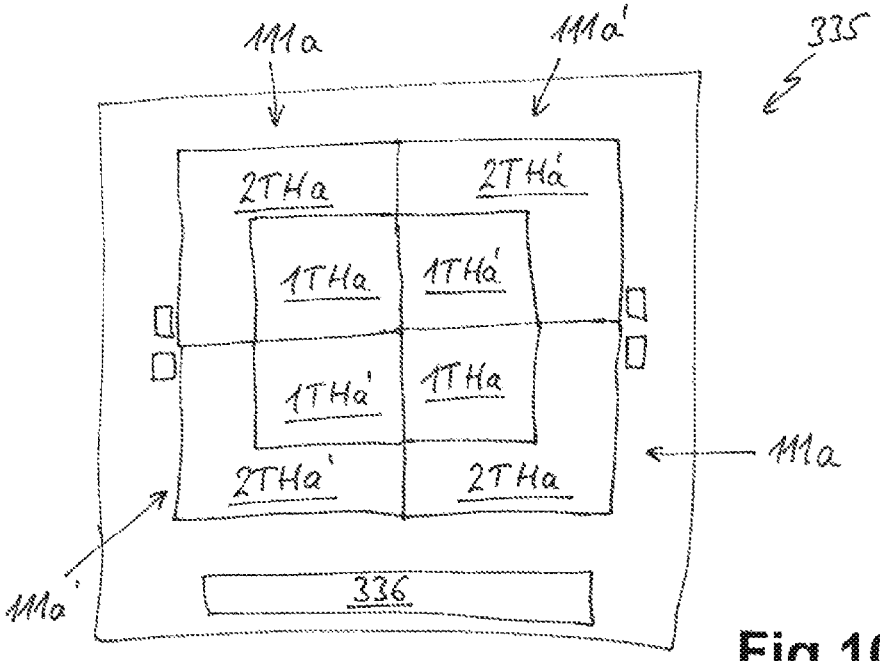
FIG. 10 shows a further hob according to the invention comprising four heating devices and an operator control device, wherein four heating devices of the same outer shape are provided close to one another or adjoining one another, with their respective first partial heating areas forming a closed rectangular surface area.

Finally, in the yet further hob 335 according to the invention in line with FIG. 10, four heating devices 111*a* and 111*a*' are to be arranged very close to one another or in an abutting manner in a heating region behind a narrow long operator control device 336. These heating devices 111*a* and, respectively, 111*a*', which each have a square outer shape, are provided with the special feature that their first partial heating areas 1THa and 1THa' butt against one another in the centre or in the common central region and form a substantially closed or continuous surface area. They are all of the same size. In this case, the diagonally opposite heating devices 111*a* and, respectively, 111*a*' are each identical, with the others exhibiting mirror-image symmetry thereto. The very large surface area formed overall by the four partial heating areas 1THa and 1THa' involved can be used for heating very large cooking vessels, such as paella pans for example. It is likewise conceivable to operate the four entire heating devices 111*a* and 111*a*' with all partial heating areas 1THa, 1THa', 2THa and 2THa' completely for paella pans of this kind or the like.

The respectively associated second partial heating areas 2THa and 2THa' are then grouped overall as a kind of rectangular ring around the said first partial heating areas. Different bridge functions or bridge arrangements and therefore overall interconnections of heating areas and, respectively, partial heating areas are possible in this case too in order to be able to heat cooking vessels of respectively different sizes in an optimum manner. Here, an inner electrical connection to the first partial heating areas 1THa and 1THa' is technically somewhat more difficult and complicated since they do not even adjoin an exposed outer side of the heating device. This can also be performed by means of corresponding laying of heating conductors. It is possible to space apart the heating devices 111*a* and, respectively, 111*a*' from one another to such an extent that an electrical connection option is created in an intermediate space. However, a large distance of this kind creates problems which are undesirable for other reasons and has an adverse effect on the bridge function in a predictable manner owing to excessively large intermediate spaces. Therefore, the option of electrical supply to a partial heating area from below or else with non-incandescent electrical supplies over the respective second partial heating area 2THa and 2THa' still remains. These can be, for example, considerably thicker and therefore not heated given the same power. As an alternative, the heating conductors can be straightened at these points, so that they are not corrugated. In this way, they incandesce such that they are virtually no longer visible. Therefore, complicated connection from below is not required. These heating conductors which no longer incandesce as connections for a partial heating area can then generally be guided past the heating conductors of the other partial heating area close to the side and therefore have no or virtually no adverse effect on this area.

The invention claimed is:

1. Heating device for a hob, wherein said heating device comprising:

a flat carrier with an outer edge, said carrier having a substantially rectangular shape, exactly two heating elements, each of the exactly two heating elements having a single heating conductor, collectively forming a heating area, wherein:

said heating conductors are fastened on said carrier, each of said two heating elements defines a partial heating area, said two heating elements and said partial heating areas can be operated independently of one another and have respectively dedicated electrical connections, said partial heating areas are situated inside said rectangular shape, said partial heating areas of said two heating elements do not intersect, a first partial heating area is rectangular, extends, by way of at least two outer side of the first partial heating area, in each case to an outer edge or to an inner side of said outer edge of said carrier, and runs parallel in relation to said outer edge, a second partial heating area covers a rest of said carrier left free by said first partial heating area, said first partial heating area is situated in a corner of said carrier, and said second partial heating area has an L shape with two limbs, said two limbs having approximately equal widths and different lengths.

2. The heating device according to claim 1, wherein said first partial heating area has a square shape.

3. The heating device according to claim 1, wherein said carrier has a square shape.

4. The heating device according to claim 1, wherein an elongate temperature sensor or an elongate temperature limiter runs above said two heating elements over at least said first partial heating area.

5. The heating device according to claim 4, wherein said elongate temperature sensor or said elongate temperature limiter runs above said two heating elements also partially over said second partial heating area.

6. The heating device according to claim 4, wherein said elongate temperature sensor or said elongate temperature limiter runs from an outer edge of said carrier over at least half an extent of said carrier along a longitudinal direction of said temperature sensor or said temperature limiter over at least said first partial heating area.

7. The heating device according to claim 1, wherein a first point-type temperature sensor is arranged over at least said first partial heating area.

8. The heating device according to claim 7, wherein a further point-type temperature sensor is arranged over said second partial heating area.

9. Hob comprising a plurality of heating devices according to claim 1, wherein two of said plurality of heating devices are arranged next to one another in such a way that said respectively first partial heating areas of said two heating devices, by way of their outer sides, are situated adjacent and parallel in relation to one another.

10. The hob according to claim 9, wherein said two of said plurality of heating devices are arranged next to one another at a distance of less than 2 centimeters.

11. The hob according to claim 10, wherein said respectively first partial heating areas of said two heating devices, by way of their outer sides, are situated congruently or parallel next to one another over a same length in each case.

12. The hob according to claim 9, wherein said two heating devices which are arranged next to one another are in contact by way of their outer edges.

13. The hob according to claim 9, wherein said two heating devices which are arranged next to one another are formed with mirror-image symmetry, wherein a centre line which runs centrally between said two heating devices forms an axis of mirror-image symmetry.

14. The hob according to claim 9, wherein further heating devices are provided which are of round or oval design.

15. The hob according to claim 9, wherein precisely two rectangular heating devices of identical size are arranged next to one another in a rear region of said hob, wherein said precisely two rectangular heating devices of identical size are arranged next to one another in a front region of said hob, wherein said two heating devices, by way of in each case said outer sides of their first partial heating areas, are situated adjacent and parallel in relation to one another on at least a left-hand side or a right-hand side of said hob.

16. The hob according to claim 15, wherein said outer sides of their first partial areas are congruent or situated parallel next to one another over a same length in each case.

* * * * *